United States Patent [19]

Holcombe

[11] 4,197,681

[45] Apr. 15, 1980

[54] INFLATABLE FRAME FOR TENT

[75] Inventor: Gordon B. Holcombe, Milbrae, Calif.

[73] Assignee: Duane J. Baxter, Portland, Oreg.

[21] Appl. No.: 926,653

[22] Filed: Jul. 21, 1978

[51] Int. Cl.[2] ..... E04B 1/345

[52] U.S. Cl. ..... 52/2; 135/1 R

[58] Field of Search ..... 52/2; 135/1 R, 3 R

[56] References Cited

U.S. PATENT DOCUMENTS

| | | | |
|---|---|---|---|
| 2,591,829 | 4/1952 | Katzenmeyer | 52/2 |
| 2,682,274 | 6/1954 | Miller | 52/2 |
| 2,955,606 | 10/1960 | Walker | 52/2 |
| 3,145,719 | 8/1964 | Johnson | 52/2 |

*Primary Examiner*—Reinaldo P. Machado

*Attorney, Agent, or Firm*—Robert Louis Finkel

[57] ABSTRACT

Two substantially identical inflatable opposed frame elements, each consisting of a single unitary tube performed as by pleats or tucks causing the tube to assume a preestablished configuration when inflated, are connected at four points of intersection of the four tube ends with certain tube segments. Each inflatable element consists of an upwardly extending arch section, an upwardly extending brace section, and a substantially horizontal base section extending between and joining one foot of the arch section and the bottom of the brace section. The other foot of the arch section of each frame element intersects the base section of the other frame element, and the top of the brace section of each frame element intersects the top of the arch section of the other frame element.

20 Claims, 11 Drawing Figures

FIG. 5
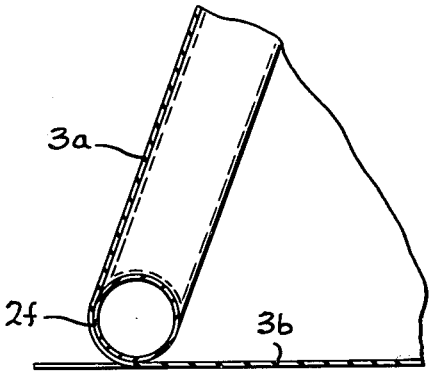
FIG. 7
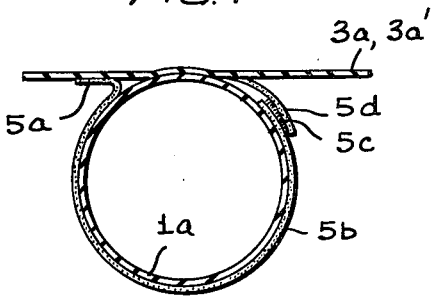
FIG. 8
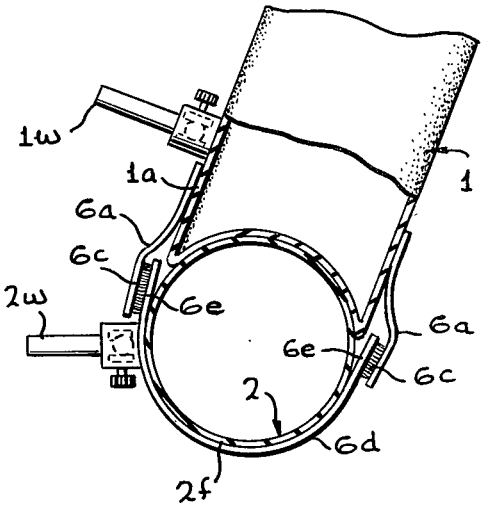
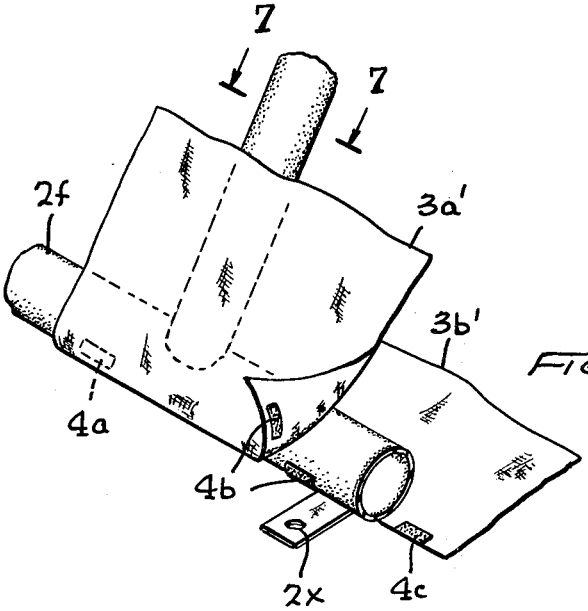
FIG. 6
FIG. 10
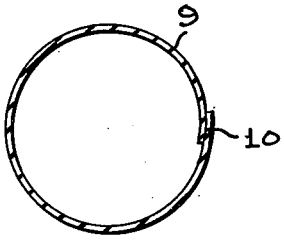
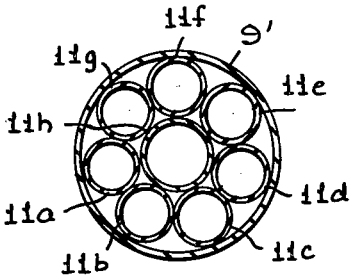
FIG. 11
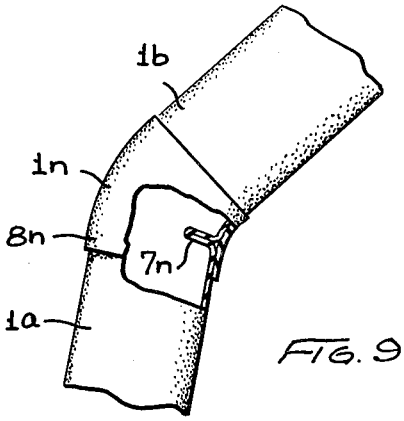
FIG. 9

INFLATABLE FRAME FOR TENT

BACKGROUND OF THE INVENTION

1. Field of the Invention

My invention relates to inflatable tents and similar temporary enclosures, and more particularly to structures of this type in which a sheltering cover is supported by an inflatable framework.

2. Prior Art

A wide range of inflatable structures appears in the prior art. At one end of this range, and most remote from the concepts of the present invention, are devices in which the tent sheathing or sheeting itself is inflatable, usually in a cellular arrangement. The prototypical art at this end of the range may be exemplified by U.S. Pat. No. 4,000,585 to Denaro, wherein an inflated cellular sheeting is supported by a conventional hardware frame—though with novel means of attachment to the ground. U.S. Pat. No. 3,540,170 to Flowers discloses a configuration in which substantially the entire sheathing is cellularly inflatable to form a self-standing frustoconical enclosure.

Near the center of the range of prior-art inflatable structures are enclosures in which the sheathing is unitary with spaced-apart inflatable frame cells. Typically the sheathing is of two-ply construction, in which the two plies are cemented or fused together everywhere except where the frame elements are desired; the unlaminated areas are simply inflated to form "ribbing"—frame elements. In U.S. Pat. No. 3,457,684 to Wood, this concept is shown embodied in such configurations as a pup-tent shape, a domed-vertical-cylinder or igloo shape, and a horizontal-half-cylinder or Quonset-hut shape. In U.S. Pat. No. 2,938,526 to Harrison et al., the same concept is shown embodied in a one-piece pyramid formed of several tetrahedral sections—with inflated rib cells along five of the six edges of each tetrahedron, and sheathing on two of the four sides of each tetrahedron; the entire pyramid may be adjusted in height by controlling (with a stretched rope or cable) the lateral distance between the bottom tips of the tetrahedra, which touch the ground.

At the other end of the range of prior-art devices, and most closely related to the present invention, are configurations in which the frame members are at least initially separate from the sheeting—though the sheeting may be strapped, glued or fused to the frame members subsequently. U.S. Pat. No. 3,899,853 to Wertman discloses sheeting having spaced-apart linear pockets, which accept simple inflatable cylindrical tubes to form parallel arched ribs of a Quonset-hut-shaped enclosure. U.S. Pat. No. 2,591,829 To Katzenmeyer et al. discloses frame segments united or jointed to produce an arched frame. A purported improvement to this is disclosed in U.S. Pat. No. 2,752,928 to Barker, wherein the frame members are preformed—that is, prearched—to prevent buckling and thus weakness of the frame. Barker shows parallel spaced tube arches with "lodgepole" tube sections connecting the tops of the arches.

The inflatable enclosure devices mentioned in the foregoing paragraphs mimic construction of hard-frame buildings. That is, they use the same structural elements and configurations as conventional structures made of wood or metal, merely substituting inflatable materials of construction for the conventional sheeting and framing materials. These prior devices thereby fail to realize the full potential for economy, sturdiness, ease of maintenance, safety, and speed of inflation and deflation which can be achieved through consideration of the basics of inflatable structures per se.

BRIEF SUMMARY OF THE INVENTION

My invention is a tent having a framework composed of two independently inflatable members which are assembled in a mutually opposed fashion. Each of the two members is a unitary, generally cylindrical tube which has two sealed ends. Typically the two frame members are provided with valves positioned to be in close proximity to one another when the structure is assembled, for ease in inflating and deflating the framework. Strapping or other attachment means are provided for attaching the members to one another, for securing the shelter cover to the frame, for securing the frame and shelter to the ground, and, if desired, for attaching equipment intended to be built into the finished structure or hung from the frame inside the finished structure. Aside from such valves and strapping or other attachment means, the inflatable members are substantially identical.

Each of the two frame members is preformed in a particular shape. I prefer to preform the frame members by providing tucks or pleats at certain points along the length of the inflatable tube. These tucks or pleats force the tube when inflated to form bends or elbows at the selected locations. Preferably the tubes are fabricated from long, relatively narrow sheets of fabric or plastic material. The tucks or pleats are formed by making transverse folds in the material at the desired positions and cementing or fusing them permanently in place. When the lateral edges of a sheet are bonded together and the ends sealed to produce an air-tight tubular casing, the shape and placement of the folds determine not only the degree but also the direction of bending at each elbow. To provide a smooth finish and strengthen and protect the tube in the region of these bends, the elbows are normally wrapped, or encased in an outer cover.

Each of the two frame members has an upwardly extending arch section which supports the tent sheeting at one end of the finished structure, and an upwardly extending brace section which helps to stabilize the arch section of the other member. The arch and brace sections of each member are connected by an intermediate base section. The base section extends between one foot of the arch section and the foot of the brace section. The base section defines one edge or side of the base of the enclosure and curves approximately halfway around the end of the base of the enclosure to a point approximately equidistant from both feet of the arch of the other frame member.

The free end of the brace section of each member meets and is secured to the central portion of the arch section of the other member. The free foot of the arch section of each member is secured to the base section of the other member, at a point opposite the other foot of that arch section.

In my preferred embodiment the arch section of each frame member is inclined upwardly away from the brace section of that frame member, so that in the finished frame the two arch sections lean away from each other. This configuration is advantageous because it tends to resist the tendency of the weight of the tent cover to pull the arch sections together (with resultant sagging of the cover). The weight of the tent-end material hanging downward over the ends of the arch sections torques the outward-leaning configuration of the arch sections further outward, stretching the cover across the top of the structure. Additionally, each frame member is capable of providing continuing support, preventing the complete collapse of the tent, in the event that the other member should become deflated.

Many, but not all, of the advantages of my invention result from the use of two independent inflatable frame members. Some of the advantages are present even if the frame is made with the four tube ends opened into and made integral with the mating tubing segments at the points where I prefer simply to secure them. Such a configuration, for example, retains the above-mentioned resistance against sagging of the tent cover.

The foregoing features and advantages will be more clearly understood by reference to the appended drawings, wherein:

BRIEF DESCRIPTION OF THE DRAWINGS

FIG. 5 is an elevation, partly in cross-section, such as might be taken along the line 8—8 of FIG. 2, showing the relationship between the frame and the tent sheeting, in one embodiment of the invention; and FIG. 6 is an elevation showing in isometric projection the relationship between frame and sheeting in the same portion of the frame as represented in FIG. 5, but in an embodiment which is alternative to that of FIG. 5.

FIG. 7 is a cross-sectional view taken along the lines 7—7 of FIG. 6, further detailing the attachment of the sheeting to the frame.

FIG. 8 is an elevation, partly in cross-section, showing the securing of two frame members together, as may be taken along the lines 8—8 of FIG. 2, and also showing one convenient location for the valving of the two frame members.

FIG. 9 is a general elevation, partly cut away, showing the pleat or tuck method of forming elbows or corners in the tubing.

FIGS. 10 and 11 are end-on cross-sectional views of the frame tubing, showing two alternative constructions of the inflatable tube itself.

DETAILED DESCRIPTION OF PREFERRED EMBODIMENTS

Figure 1:
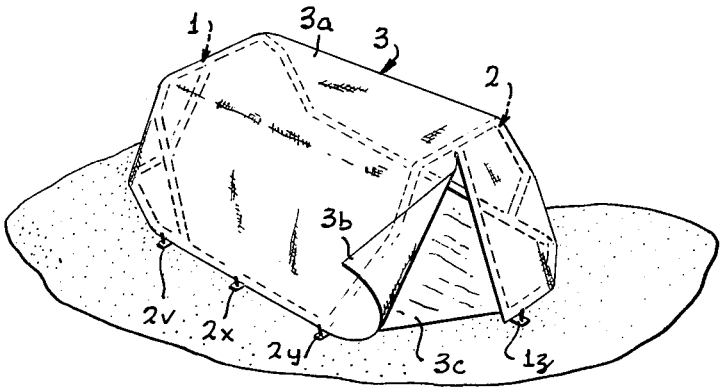
FIG. 1 is an isometric view showing a tent embodying the subject invention, the concealed portions of the inflated frame being shown in phantom.
Figure 2:
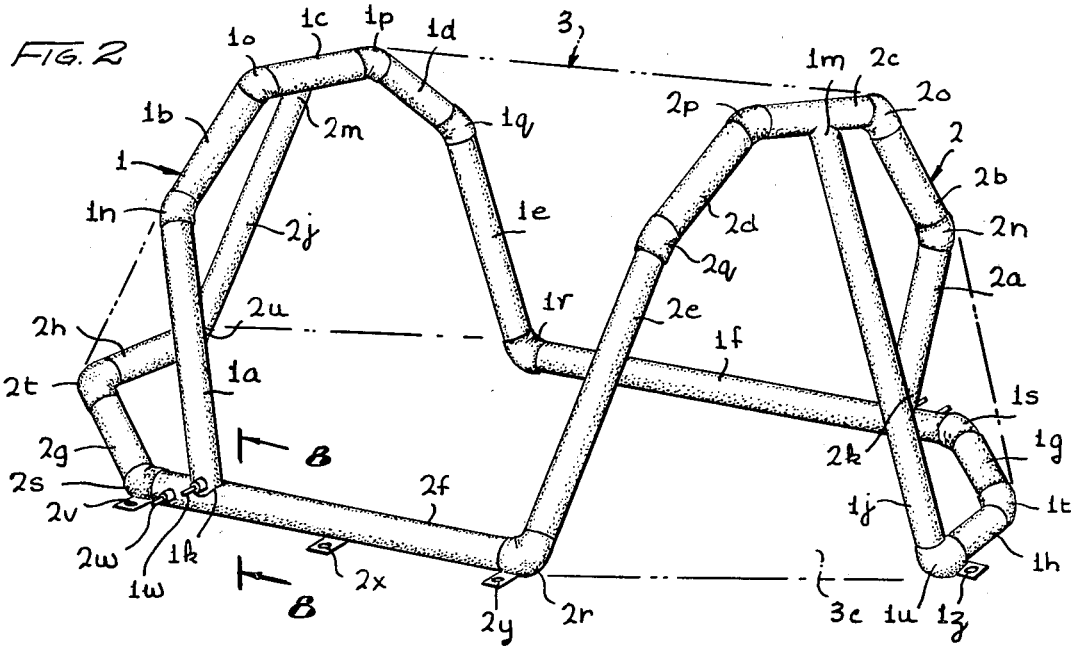
FIG. 2 is an isometric view of the tent frame of FIG. 1 with the sheeting removed.
Figure 3:
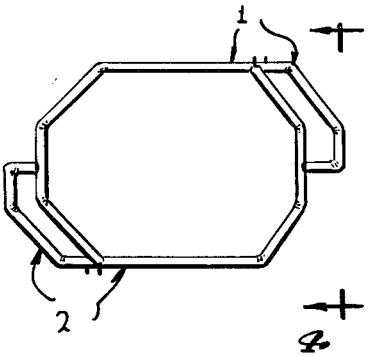
FIG. 3 is a plan or top-orthographic view of the structure of FIG. 2.
Figure 4:
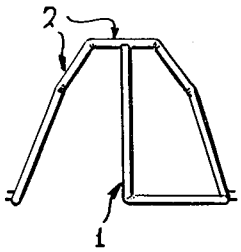
FIG. 4 is an end-on elevation or orthographic view of the same structure.

The general arrangement of the two substantially identical frame elements 1 and 2 and the sheeting 3 is shown in FIGS. 1 through 4. Typically the sheeting comprises upper portions 3*a*, with openable end-flap 3*b*, and flooring 3*c* if desired. The structure may be secured to the ground by pegs driven through grommeted loops 2*v*, 2*x*, 2*y*, 1*z* and corresponding others on the concealed side of the structure.

Frame member 1, preferably made of a single unitary tube having two ends 1*k* and 1*m*, and provided with conventional inflation/deflation valve 1*w*, forms straight sections 1*a* through 1*j*, separated by elbows 1*m* through 1*u*. Likewise frame member 2, having two ends 2*k* and 2*m*, and provided with inflation/deflation valve 2*w*, forms straight sections 2*a* through 2*j*, separated by elbows 2*n* through 2*u*.

Frame member 1 may be regarded as composed of an arch section 1*a* through 1*e*, and elbows 1*n* through 1*q*; a brace section 1*j*; and intervening base section 1*f* through 1*h*, and elbows 1*s* and 1*t*. The base section 1*f*-1*s*-1*g*-1*t*-1*h* is connected at elbow 1*r* to one foot 1*e* of the arch section 1*a*-1*n*-1*b*-1*o*-1*c*-1*p*-1*d*-1*q*-1*e*; and is connected at elbow 1*u* to the bottom of the brace section 1*j*. The term "connected" here refers to the abstraction of the connection of the conceptual arch, base and brace sections, whereas these sections are actually portions of a single continuous, unitary tube.

Likewise frame member 2 may be regarded as composed of an arch section 2*a* through 2*e*, and elbows 2*n* through 2*q*; a brace section 2*j*; and intervening base section 2*f* through 2*h*, and elbows 2*s* and 2*t*. The base section 2*f*-2*s*-2*g*-2*t*-2*h* is connected at elbow 2*r* to one foot 2*e* of the arch section 2*a*-2*n*-2*b*-2*o*-2*c*-2*p*-2*d*-2*q*-2*e*; and is connected at elbow 2*u* to the bottom of the brace section 2*j*. The term "connected" is here again used abstractly.

The free foot 1*k* of frame member 1 meets the base section 2*f* of the other frame member 2, and the free end 1*m* at the top of the brace section 1*j* of the frame member 1 meets the apex 2*c* of the other frame member 2.

Similarly, the free foot 2*k* of frame member 2 meets the base section 1*f* of the other frame member 1, and the free end 2*m* at the top of the brace section 2*j* of the frame member 2 meets the apex 1*c* of the other frame member 1.

The two frame members are secured to each other at the immediately aforementioned four points of meeting. A typical arrangement for securing the members together is shown in FIG. 8, which also incidentally shows the two valves 1*w* and 2*w* of the two frame members 1 and 2 respectively. The means for securing the frame members together shown here comprise two straps 6*b*, cemented, fused or otherwise permanently connected to the opposite sides of straight section 1*a* of frame member 1; another strap 6*d* passed around straight section 2*f* of frame member 2, and secured thereto if desired; and mating Velcro or equivalent strips 6*c* for securing the ends 6*e* of strap 6*d* to the ends of straps 6*b*. If preferred, snaps, buckles, blunt hooks, or any of a great variety of other attachment means may be substituted for the Velcro strips.

If desired the two valves 1*w* and 2*w* may be replaced by, or generally left open and augmented by, a single valve (not shown) connected to both inflation points in parallel.

As previously mentioned, certain of the advantages of my invention are retained in an alternative embodiment in which each of the four tubing ends 1*k*, 1*m*, 2*k* and 2*m* is opened into and fused or cemented to the mating tube section 2*f*, 2*c*, 1*f* or 1*c*, respectively. In this alternative embodiment the frame is a single integral unit having two arch sections, two brace sections and two base sections with a common, communicating interior. However, even in this case, for ease of inflation using standard fittings it could be preferable to provide either one or two valves, depending on the particular application involved; thus all of the appended drawings except FIG. 8 illustrate equally well the two-element-frame and the integral-frame embodiments.

The present invention would also of course encompass constructions in which tubing segments were opened into each other at certain of the four joints but not other(s).

As shown in FIG. 5 the side sheeting 3*a* and floor sheeting 3*b* may in fact be a unitary sheet wrapped around the base member 2*f*—and likewise at the other side of the structure base—with a zippered or other appropriate seam placed wherever preferred for convenience.

In the alternative, as shown in FIG. 6, the side sheeting 3*a'* and floor sheeting 3*b'* may be separate, and may be separately secured to the frame member 2*f* as by mating Velcro strips 4*a*, 4*b*, 4*c*, etc.

The either case the sheeting 3*a* or 3*a'* may be generally secured to the vertical member 1*a* as illustrated in FIG. 7 by straps 5*b* spaced along the length of the vertical member 1*a*, the straps 5*b* being cemented, glued or fused as at 5*a* to the interior of the sheeting 3*a* or 3*a'*, and being secured by mating Velcro strips 5*c* to straps 5*d* similarly fused, glued or cemented to the interior of the sheeting 3*a*, 3*a'*. The sheeting is attached to the frame in this fashion merely to prevent excessive flapping or chafing. This attachment does not directly contribute structural stability.

Each corner or elbow is formed by taking a tuck or pleat in the material of the tubular frame element. The angle between the straight sections at each corner, and the orientation of that angle about the axis of the tubular element, are respectively controlled by the amount of material taken in the tuck and the orientation of the tuck about the axis, as will be apparent from consideration of FIG. 9, which for definiteness refers to the elbow 1*n* between straight sections 1*a* and 1*b* of frame element 1. As shown, the tube angles in the direction of the side of the tube where the tuck 7*n* is taken. The longer the tuck—that is, the greater the amount of material fused into the tuck—the sharper the angle between the straight sections. The elbow may be stabilized, protected and dressed by encasing it in wrapping 8*n*, which may be of resilient material such as synthetic rubber or may be a plastic sleeve shrunk into place over the elbow.

While all the features discussed with reference to FIGS. 5 through 9 are for definiteness related to specific portions 1*a*, 2*f*, 1*b* and 1*n* of the frame, it is to be understood that these references are intended only as exemplary of analogous frame locations where the same features come into play.

The frame elements 1 and 2 may be made, as shown in FIG. 10, of flat material 9 curved into a generally cylindrical shape with a fused, cemented or glued lap at 10; or in the alternative (not shown) may be made of extruded tubing.

The frame elements may be simple hollow tubing, or may as shown in FIG. 11 be "bladdered," that is, formed with a plurality of smaller tubes such as 11*a* through 11*h* placed within outer casing 9', at least along portions of the frame length where the greatest strength is desired.

As one example of the finished product which may be constructed in accordance with my invention, the structure illustrated in FIGS. 1 through 4 may stand seven feet tall, with outer dimensions of the base approximately nine feet wide and fourteen feet long. (In addition, entrance areas can be extensible into work areas protected from the weather.) In such a structure, frame tubing six inches in diameter would be suitable. However, the design lends itself to increased or decreased size in all dimensions, with reasonable maintenance of proportionality.

Because of the simple frame construction, which is particularly economical for moderately short-run production, my invention produces relatively inexpensive though extremely sturdy and stable structures.

Its two main frame elements provide the benefits associated with interchangeable parts.

Because of the large-diameter tubing and simple construction, it is more rapidly inflatable and deflatable, and more completely deflatable—unless bladdered. The large-diameter tubes are more readily patched than small-diameter tubes appropriate for other inflatable-frame designs.

The structure's lightness aloft tends to resist wind deformation, unlike some prior-art inflatable-frame structures in which a concentration of elevated frame members occurs along the length of the enclosure.

The inflatable frame members may be made of urethane coated polyester, approximately 2 ounces per square yard polyester caseweight, with urethane exterior coating approximately 1 ounce per square yard and interior coating approximately 3 ounces per square yard, for a total weight of 6 ounces pe square yard.

In the alternative, an uncoated polyester fabric casing, of about 3 ounces per square yard, may be sewn into tubular shape with urethane film bladder, also 3 ounces per square yard, inside the casing. Such a bladder may be longitudinally multichambered., and preferably should be slightly larger in diameter (when unrestrained) than the casing.

The sheeting may be sailcloth. For waterproofing of the upper sections of the sheeting, where water can lie on the top of the structure, the sailcloth may be lightly coated with urethane or vinyl (though the latter tends to become tacky with age). The sheeting may be 3 to 3.5 ounces per square yard, including the waterproofing. Below the upper sections of the sheeting, depending on the intended application, the side sheeting may be water-repellant sailcloth, or may be water-repellant treated.

The flooring if separate from the top sheeting may be woven polyethylene, generally 4 ounces per square yard, sewn and waterproofed at its seams, or preferably impulse-welded.

The finished structure may be deflated, transported and reinflated without disassembly, the bottom sheeting serving as a pack.

If desired, additional large relief valves may be provided for the two frame elements respectively, to facilitate complete deflation, should check valves 1*w*, 2*w* not allow sufficiently rapid or complete deflation.

It will be understood that the foregoing examples and details have been chosen for illustrative purposes, and are not intended to limit the scope of my invention as it is defined by the following claims.

What is claimed is:

1. An inflatable frame member for a tent, comprising:

a single, unitary hollow tube, having exactly two ends and being sealed at both ends, means for inflating the tube, and a plurality of pleats in the tube, causing the tube when inflated to form itself into a plurality of substantially straight sections meeting at the pleat locations, the straight sections assuming predetermined relative orientations with respect to one another and defining an upwardly extending arch section, an upwardly extending brace section, and a substantially horizontal base section extending between and joining one foot of the arch section and the bottom of the brace section.

2. An inflatable frame for a tent, comprising two substantially identical members each as defined in claim 1, wherein the top of the brace section of each member meets the upper portion of the arch section of the other member.

3. The frame of claim 2 wherein the other foot of the arch section of each member meets the base section of the other member.

4. The frame of claim 3, also comprising means for securing the members to each other at the points where they meet.

5. The frame of claim 4, in combination with sheeting material secured to the frame and defining an enclosure when the frame members are inflated.

6. The combination of claim 5 wherein the two arch sections lean away from each other when inflated.

7. The frame of claim 2, wherein the arch sections lean away from each other when inflated.

8. An inflatable frame for a tent, comprising two substantially identical members each as defined in claim 1, wherein the other foot of the arch section of each member meets the base section of the other member.

9. The frame member of claim 1, wherein the arch section is angled upwardly away from the brace section.

10. An inflatable frame for a tent, comprising two identical inflatable members, each having an upwardly extending arch section, an upwardly extending brace section, and a laterally extending base section extending between and joining one foot of the arch section and one end of the brace section; and wherein the other foot of the arch section of each member meets the base section of the other member; and the other end of the brace section of each member meets the arch section of the other member.

11. The frame of claim 10, also comprising means for securing the members to each other at the points where they meet.

12. The frame of claim 11 wherein the securing means are releasable and refastenable.

13. The frame of claim 10, wherein the arch sections are angled upwardly away from each other.

14. An inflatable frame member for a tent, comprising:

a single, unitary hollow tube, having exactly two ends and being sealed at both ends, and means for inflating the tube; and the tube being formed into:

an upwardly extending arch, an upwardly extending brace, and a substantially horizontal base extending between and joining one foot of the arch and the brace.

15. An inflatable frame for a tent, comprising two substantially identical members each as defined in claim 14, wherein the other foot of the arch of each member meets the base of the other member.

16. The frame of claim 15 wherein the top of the brace of each member meets the upper portion of the arch of the other member.

17. An inflatable frame for a tent, comprising:

two upwardly extending arches at opposite ends of the frame, each arch having two feet, two substantially horizontal base sections on opposite sides of the frame, each extending between and joining one foot of one arch and one foot of the the other arch, two braces, one at each end of the frame, each brace being joined:

at one of its two ends, near the juncture of one foot of a particular arch with one of the base sections, and at its other end to the upper portion of the said particular arch; and means for inflating the frame.

18. The frame of claim 17 wherein each brace section comprises:

a substantially horizontal segment joined at said juncture and extending to a point roughly equidistant from the two feet of the said particular arch, and an upwardly extending segment between the said equidistant point and the upper portion of the said particular arch.

19. The frame of claim 17 wherein:

the arches, base sections and braces are opened into each other and permanently made integral at each point where they are joined, and the arches, base sections and braces have one common, mutually communicating inflatable interior.

20. The frame of claim 18 wherein:

the arches, base sections and braces are opened into each other and permanently made integral at each point where they are joined, and the arches, base sections and braces have one common, mutually communicating inflatable interior.

* * * * *